US005951261A

United States Patent [19]

Paczuski

[11] Patent Number: 5,951,261

[45] Date of Patent: Sep. 14, 1999

[54] REVERSIBLE DRIVE COMPRESSOR

[75] Inventor: Andrew W. Paczuski, Adrian, Mich.

[73] Assignee: Tecumseh Products Company, Tecumseh, Mich.

[21] Appl. No.: 09/099,013

[22] Filed: Jun. 17, 1998

[51] Int. Cl.[6] ..... F04B 19/00; F04B 37/00; F01B 9/02

[52] U.S. Cl. ..... 417/315; 417/221; 92/13

[58] Field of Search ..... 92/13, 13.3, 13.4, 92/13.5; 417/221, 315

[56] References Cited

U.S. PATENT DOCUMENTS

| | | | |
|---|---|---|---|
| 1,556,912 | 10/1925 | Canoose . | |
| 1,557,222 | 10/1925 | Warner . | |
| 1,565,819 | 12/1925 | Saunders . | |
| 1,814,154 | 7/1931 | Hartley . | |
| 1,867,198 | 7/1932 | Waite | 417/221 |
| 1,946,559 | 2/1934 | Weiskopf . | |
| 2,035,096 | 3/1936 | Schneider . | |
| 2,528,764 | 11/1950 | Leonard . | |
| 2,561,786 | 7/1951 | Davis . | |
| 2,592,237 | 4/1952 | Bradley . | |
| 2,612,839 | 10/1952 | Denny . | |
| 2,780,334 | 2/1957 | Simmons . | |
| 2,873,003 | 2/1959 | Meinelt . | |
| 2,892,360 | 6/1959 | Ill . | |
| 2,943,782 | 7/1960 | McGregor . | |
| 3,010,339 | 11/1961 | Brock | 74/568 |
| 3,022,741 | 2/1962 | Brundage | 417/315 |
| 3,174,436 | 3/1965 | Wanner . | |
| 3,180,178 | 4/1965 | Brown et al. | 92/13.7 X |
| 3,259,307 | 7/1966 | Ayling . | |
| 3,360,952 | 1/1968 | Lewis . | |
| 3,417,628 | 12/1968 | Paul, Jr. . | |
| 3,470,823 | 10/1969 | Seeger . | |
| 3,522,998 | 8/1970 | Johnson | 417/221 |
| 3,545,220 | 12/1970 | Teegarden . | |
| 3,701,350 | 10/1972 | Guenther . | |
| 3,738,230 | 6/1973 | Censi . | |
| 3,985,473 | 10/1976 | King et al. | 417/315 |
| 4,031,778 | 6/1977 | Fazekas | 92/13.3 X |
| 4,143,995 | 3/1979 | Divisi . | |
| 4,236,874 | 12/1980 | Sisk | 417/315 |
| 4,245,966 | 1/1981 | Riffe | 417/539 |
| 4,479,419 | 10/1984 | Wolfe | 417/539 X |
| 4,494,447 | 1/1985 | Sisk | 92/13.3 |
| 4,682,532 | 7/1987 | Erlandson . | |
| 4,756,202 | 7/1988 | Kawamoto | 74/23 |
| 4,830,589 | 5/1989 | Pareja . | |
| 5,190,263 | 3/1993 | Roberts | 92/13.2 X |
| 5,199,857 | 4/1993 | Sanuki | 417/319 |
| 5,281,110 | 1/1994 | Dreiman | 417/415 |
| 5,366,355 | 11/1994 | Patterson | 417/315 X |
| 5,577,390 | 11/1996 | Kaido et al. . | |

FOREIGN PATENT DOCUMENTS

| | | |
|---|---|---|
| 153267 | 3/1932 | Switzerland . |
| 827843 | 5/1981 | U.S.S.R. . |
| 315695 | 1/1930 | United Kingdom . |
| 333533 | 8/1930 | United Kingdom . |

*Primary Examiner*—John E. Ryznic
*Attorney, Agent, or Firm*—Baker & Daniels

[57] ABSTRACT

A reciprocating piston compressor including at least one cylinder, a reciprocable piston disposed therein, a crankshaft rotatable in forward and reverse directions and having an eccentric crankpin, and a cam disposed about the crankpin, the piston operatively connected to the cam. The cam is rotatable about the crankpin between a first angular position corresponding to a first piston stroke length during forward crankshaft rotation and a second angular position corresponding to a second piston stroke length during reverse crankshaft rotation. In one of its first and second angular positions, the cam is rotatably locked to the crankpin.

13 Claims, 6 Drawing Sheets

FIG_2A
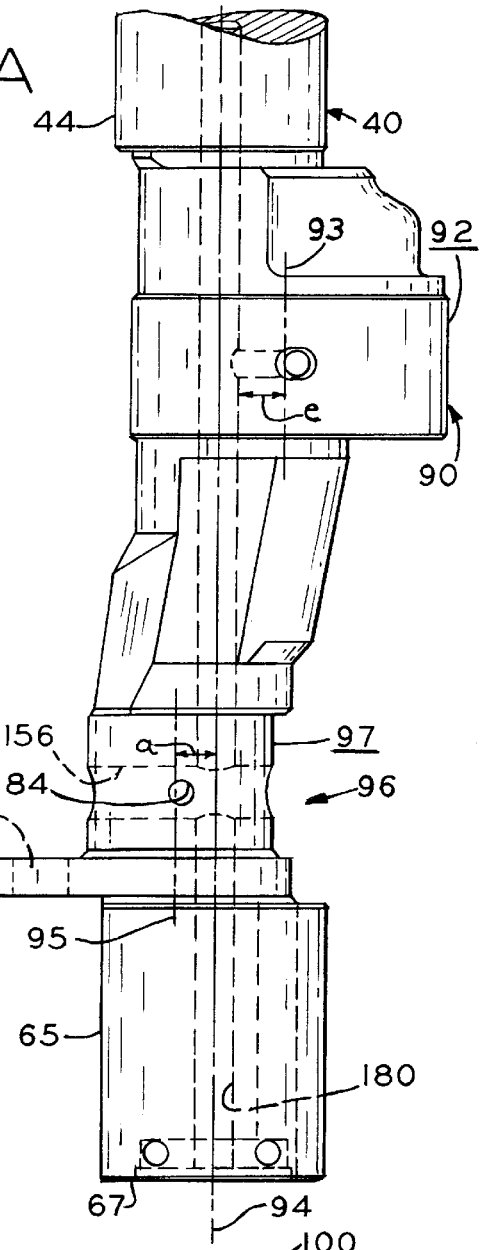
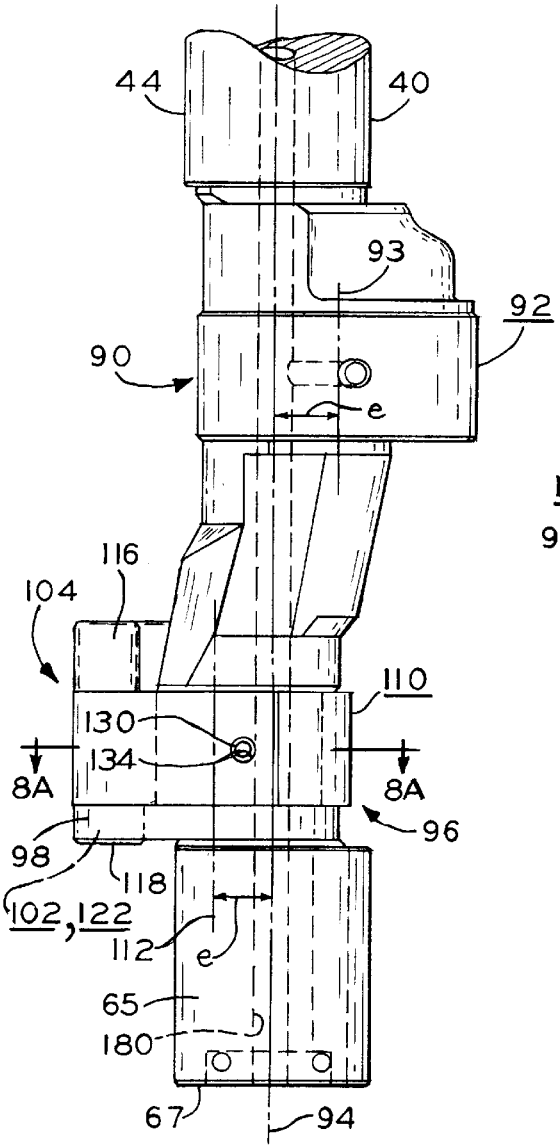
FIG_4
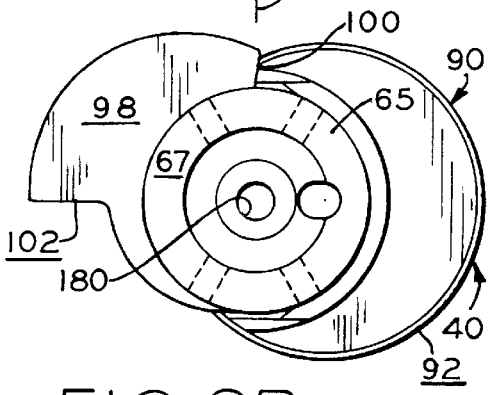
FIG_2B

REVERSIBLE DRIVE COMPRESSOR

BACKGROUND OF THE INVENTION

The present invention pertains to reversible reciprocating piston machines, and particularly to reversible reciprocating piston compressors.

Reciprocating piston compressors, such as the compressor disclosed in U.S. Pat. No. 5,281,110, which is assigned to the present assignee, the disclosure of which is incorporated herein by reference, are generally of fixed displacement and powered by a rotating driving source which operates in a single direction. Also known in the art are reversible reciprocating piston compressors in which a piston has a first stroke length when driven by a crankshaft rotating in a first, forward direction, and a second stroke length when driven by the crankshaft rotating in a second, reverse direction, through use of an eccentric cam which rotates relative to the crankshaft between stops thereon corresponding to first and second angular cam positions which, in turn, correspond to the first and second stroke lengths. These reversible compressors provide the advantage of having one displacement when the crankshaft is rotated in the forward direction, and another displacement when the crankshaft is rotated in the reverse direction. Previous dual stroke, reversible drive compressors, however, do not provide means for positively maintaining the cam in the angular position corresponding to the greater stroke length during rotation of the crankshaft. If the cam is not continually maintained in this angular position during crankshaft rotation, the reexpansion of gas in the cylinder after the piston reaches top-dead-center (TDC) may force the piston away from its TDC position at such a speed that the cam may rotate relative to the crankshaft, separating the cam and crankshaft stops. The separation of these stops result in their subsequently slamming together as the rotating crankshaft catches up to the cam, causing undue stresses on the components, adversely affecting durability, and undesirable noise.

SUMMARY OF THE INVENTION

The present invention addresses this shortcoming of previous dual stroke, reversible drive compressors by providing a reciprocating piston compressor including at least one cylinder, a reciprocable piston disposed in the cylinder, a crankshaft rotatable in both forward and reverse directions and having a cylindrical eccentric portion, and a cam disposed about the eccentric portion, the piston operatively connected to the cam. The cam is rotatable about the eccentric portion between a first position corresponding to a first piston stroke length during forward crankshaft rotation, and a second position corresponding to a second piston stroke length during reverse crankshaft rotation. In one of its first and second positions, the cam is rotatably locked to the eccentric portion.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 2A is a fragmentary side view of the crankshaft of the compressor of FIG. 1;

FIG. 2B is an end view of the crankshaft of FIG. 2A;

FIG. 4 is a fragmentary side view of the crankshaft of FIG. 2A with the cam assembly of FIG. 3 attached thereto;

Figure 1:
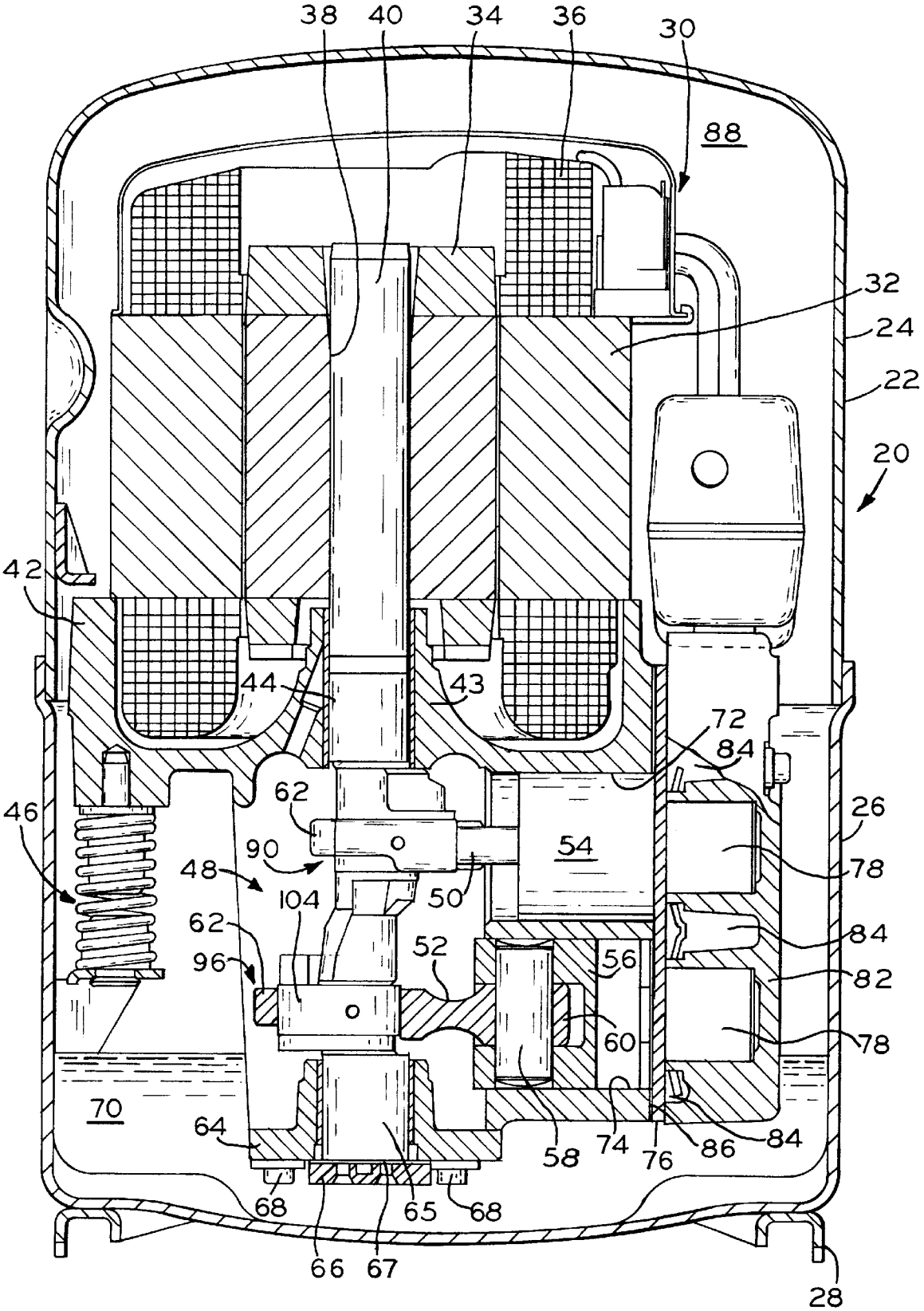
FIG. 1 is a sectional side view showing a first embodiment of a compressor according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DETAILED DESCRIPTION OF THE INVENTION

Referring to FIG. 1 there is shown compressor assembly 20, which is part of a refrigeration or air conditioning system (not shown). Compressor assembly 20 has housing 22 which is comprised of top portion 24 and bottom portion 26. The two housing portions are welded or bolted together. Mounting bracket 28 is attached to lower housing portion 26. Although compressor assembly 20 has a vertical shaft orientation, the scope of the present invention encompasses reversible compressors having a horizontal shaft orientation as well.

Located within hermetically sealed housing 22 is reversible electric motor assembly 30 having stator 32 provided with windings 36, and rotor 34 provided with central aperture 38 in which crankshaft 40 is secured by means of an interference fit. A terminal cluster (not shown) is provided in housing 22 for connecting motor assembly 30 to a switchable source of electrical power for causing rotor 34 and attached crankshaft 40 to selectively rotate in either a forward or reverse direction. Stator 32 is supported in housing 22 by means of its attachment to crankcase 42.

Crankcase 42 has central bearing portion 43 which radially supports upper journal portion 44 of crankshaft 40. Shock mounts 46, attached to crankcase 42 and lower housing section 26, suspend electric motor assembly 30 and the compressor components within housing 22.

Crankcase 42 defines running gear cavity 48 in which the two eccentric crankpins of crankshaft 40 and other compressor parts are disposed. Although compressor assembly 20 is a dual cylinder compressor, the scope of the present invention encompasses not only multicylinder compressors, but single cylinder compressors as well. Connecting rods 50, 52, which may be identical, are respectively connected to pistons 54, 56 by means of wrist pins 58 which extend through a lateral bore in each piston and wrist end 60 of each connecting rod. Connecting rods 50, 52 are each connected to crankshaft 40 by rod strap 62 which surrounds the respective crankpin. Outboard bearing 64 is attached to crankcase 42 by means of bolts 68, and radially supports crankshaft lower journal portion 65. Thrust bearing plate 66 is attached to outboard bearing 64 and axially supports end surface 67 of the crankshaft. Bolts 68 also attach plate 66 to outboard bearing 64.

Lower housing portion 26 contains oil sump 70, in which is disposed oil for lubricating the compressor components. Normally, the oil surface level is above outboard bearing 64 and in contact with lower piston 56. Pistons 54, 56 respectively reciprocate within equal diameter cylinders 72, 74 formed in crankcase 42. Refrigerant gas is drawn into cylinders 72, 74 at suction pressure and expelled therefrom in a compressed state at discharge pressure through respective, valved suction and discharge ports (not shown) provided in valve plate 76 which covers the cylinder openings. Refrigerant gas is drawn through the suction ports of plate 76 into the cylinders from suction chamber 78 of head 82, which is attached to crankcase 42 by means of bolts (not shown) which extend through valve plate 76. Suction chamber 78 is fluidly connected to the interior chamber 88 of compressor assembly 20, which receives low pressure refrigerant gas from the system. Compressed refrigerant gas is forced from the cylinders through the discharge ports of plate 76 into discharge chamber 84 of head 82, from which the discharge pressure gas exits through an elongate, somewhat flexible shock tube (not shown) which extends through the housing wall and provides compressed refrigerant to the system.

Referring to FIG. 2A, it can be seen that upper crankpin 90 of crankshaft 40, which is associated with connecting rod 50 and piston 54, has large cylindrical surface 92 having central axis 93 which is parallel with and offset from crankshaft axis of rotation 94. Surface 92 is in sliding contact with the surrounding interior surface of rod strap 62. Axes 93 and 94 are offset by distance c, the eccentricity of upper crankpin 90, which corresponds to one half the stroke distance of piston 54 in cylinder 72. Lower crankpin 96, which is associated with connecting rod 52 and piston 56, has small cylindrical surface 97 having central axis 95 which is parallel with and offset from crankshaft axis of rotation 94. Axes 94 and 95 are offset by distance a, the eccentricity of lower crankpin 96, which is less than distance e. Axes 93, 94 and 95 lie in a plane, with axis 95 located 180° about axis 94 from axis 93 (i.e., completely out of phase with axis 93 as shaft 40 rotates about axis 94). Referring to FIG. 2B, immediately adjacent crankpin 96 and formed in crankshaft 40 is flange 98 having, as shown in FIG. 2B, first and second driving surfaces 100 and 102, respectively.

Figure 3A:
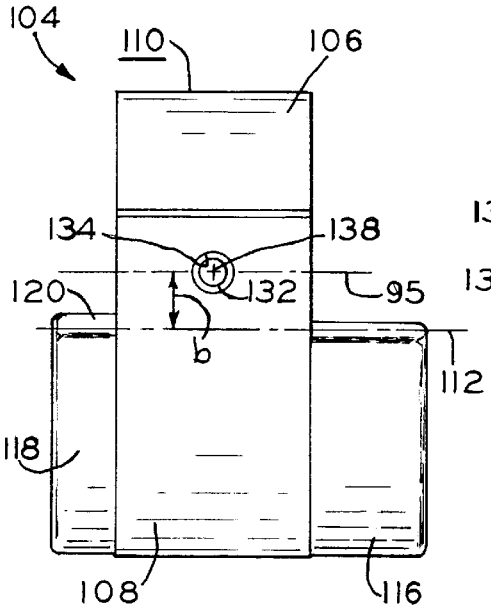
FIG. 3A is a first side view of a first embodiment of a cam assembly according to the present invention.
Figure 3B:
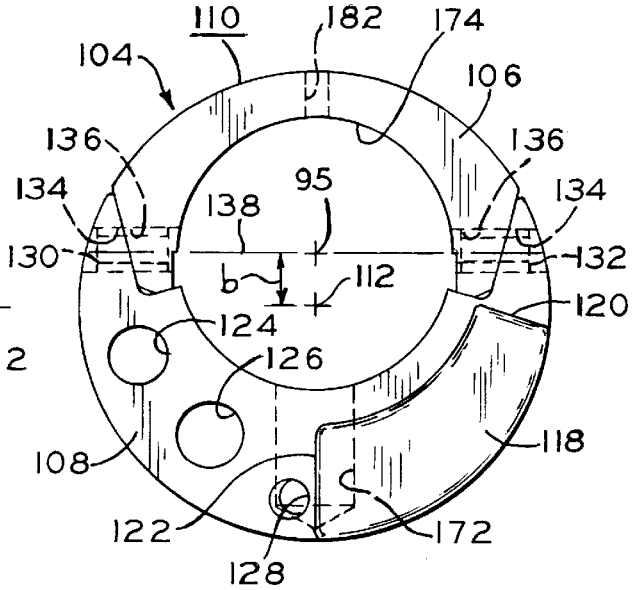
FIG. 3B is an end view of the cam assembly of FIG. 3A.
Figure 3C:
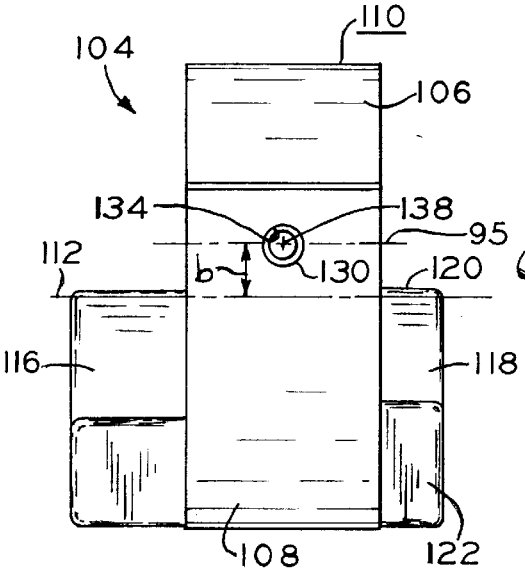
FIG. 3C is a second side view of the cam assembly of FIG. 3A.
Figure 3D:
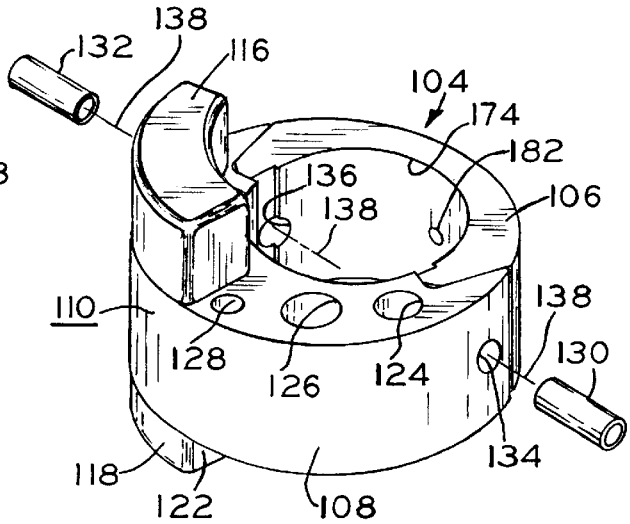
FIG. 3D is a partially exploded, perspective view of the cam assembly of FIGS. 3A–3C.
Figure 5:
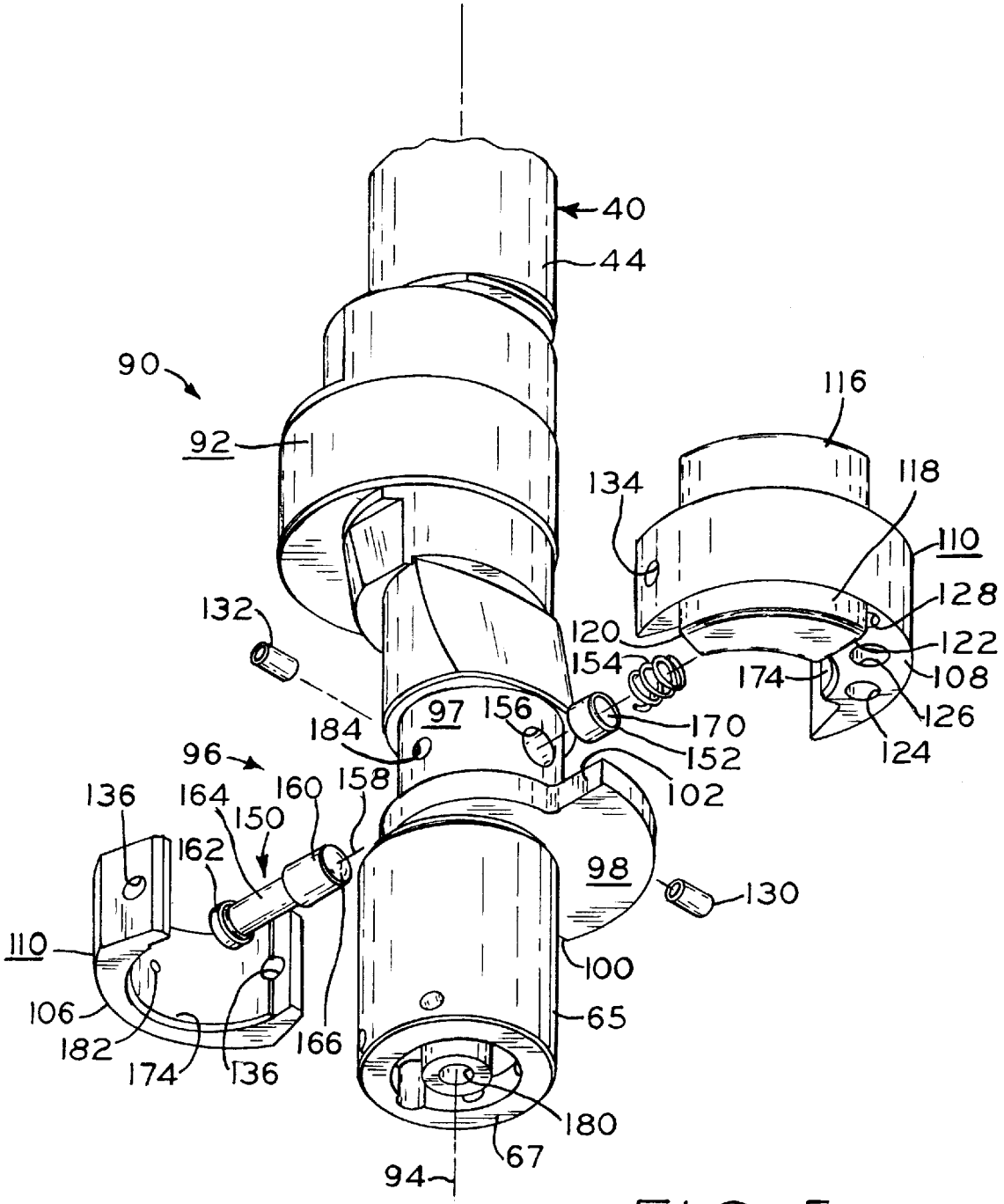
FIG. 5A is an exploded, perspective view of the crankshaft and cam assembly of FIG. 4.

Referring now to FIGS. 3A–3D, there is shown a first embodiment of a cam assembly for use in the present invention. Cam assembly 104 comprises yoke portion 106 and base portion 108, each of which may be heat treated and nitrided sintered powdered metal, and which are assembled about lower crankpin 96 as shown in FIGS. 4 and 5 and discussed further below. Yoke portion 106 and base portion 108 are a matched pair and are machined together in assembled form. When fitted together, yoke portion 106 and base portion 108 define cylindrical outer surface 110 having central axis 112 which is parallel to and offset from central axis 95 of lower crankpin 96 (FIGS. 2A, 3B). Axes 95 and 112 are offset by distance b which, in the shown embodiment of compressor assembly 20, is equivalent to distance a. Axially extending from one side of base portion 108 is generally arcuate counterweight portion 116. Extending from the opposite axial face of base portion 108 is generally arcuate driven portion 118 which, to a lesser extent than portion 116, also acts as a counterweight. At opposite circumferential ends of driven portion 118 are surfaces 120 and 122, which alternatingly abut surfaces 100 and 102 of crankshaft flange 98, respectively, when crankshaft 40 is driven forward and reverse directions. Hence, cam assembly 104 has a first angular position about lower crankpin 96 when surfaces 102 and 122 abut, during forward rotation of crankshaft 40, and a second angular position about lower crankpin 96 when surfaces 100 and 120 abut, during reverse rotation of crankshaft 40, as will be described further below. As shown in FIGS. 3B and 3D, base portion 108 is provided with axial holes 124, 126 and 128 which serve to properly locate the center of mass of cam assembly 104 in each of its and second angular positions.

Referring to FIGS. 3B, 3D and 5, after base portion 108 and yoke portion 106 are assembled together about lower crankpin 96, they are secured together by interference fitting spring pins 130 and 132, which are usually sheet steel rolled into a hollow, cylindrical configuration, into aligned crossbores 134 and 136 extending along axis 138, which perpendicularly intersects central axis 95 of the crankpin. Alternatively, yoke portion 106 and base portion 108 may be merely interfitted together and held in their assembled form by virtue of cam 104 being captured in the radial direction by the inner cylindrical surface of rod strap 62 and in the axial direction by adjacent, abutting axial surfaces of crankshaft 40. Further, cam 104 may comprise a single piece having the same overall shape and features as interfitted portions 106 and 108 provide; this embodiment (not shown) would slip axially over crankpin 96 of a crankshaft comprising two pieces bolted together at either end of the crankpin. Notably, this alternative, single piece cam embodiment would also have a crossbore extending from the inner cylindrical cam surface to the outer cylindrical cam surface, similar to the conduit formed by crossbores 134 and 136, for conveying oil to surface 110, as described further below.

Referring to FIG. 4, in which cam assembly 104 is shown in its first angular position, with its driven surface 122 abutting crankshaft flange driving surface 102, central axis 112 lies in the same plane as axes 93, 94 and 95, and lies distance e from crankshaft axis of rotation 94, equally eccentric and completely out of phase with the central axis of upper crankpin 90. Thus, in the shown embodiment, distance e equals the sum of distances a and b (e=a+b). In the shown embodiment of compressor 20, distance a is equivalent to distance b. It can be readily understood from the above that during forward rotation of crankshaft 40, with cam assembly 104 maintained in its first angular position about lower crankpin 96, pistons 54 and 56 may have a common stroke distance and common displacement, although different stroke combinations may be used. Thus, compressor assembly 20 achieves its maximum displacement during forward crankshaft rotation.

Conversely, with cam assembly 104 in its second angular position (not shown), in which its driven surface 120 abuts crankshaft flange driving surface 100, during reverse rotation of crankshaft 40, cam assembly central axis 112 assumes a position in the plane containing axes 93, 94 and 95, lying between axis 93 and axis 95. In the shown embodiment of compressor 20, where distance a is equivalent to distance b, axis 112 is superimposed upon crankshaft axis of rotation 94 when cam assembly 104 assumes its second angular position about crankpin 96, and no reciprocating movement is imparted to piston 56. Hence, with surfaces 100 and 120 maintained in abutting contact during reverse crankshaft rotation, rod strap 62 of connecting rod 52 idles in place, with cam assembly rotating therein about coincident axes 94 and 112. It can be readily understood from the above that during reverse rotation of crankshaft 40, with cam assembly 104 maintained in its second angular position about lower crankpin 96, compressor assembly 20 achieves only a portion (as shown, one half) its maximum displacement. Although the shown embodiment illustrates a compressor having a first, maximum displacement which is about twice that of its second, reduced displacement, it is envisioned that the above described arrangement may be modified to produce a second, reduced displacement which is greater than or less than one half a first, maximum displacement. Further, those skilled in the art will recognize that the present invention may be adapted to single cylinder compressors which have a first displacement when rotated in the forward direction, and a second, different displacement when rotated in reverse direction.

The present invention provides a means for maintaining cam assembly 104 in its first angular position through the entire cycle of forward rotation. If cam assembly 104 were not continually maintained in its first angular position during forward crankshaft rotation, the reexpansion of the gas in cylinder 74 after piston 56 reaches TDC may force piston 56 away from its TDC position at such a speed that cam assembly 104 may rotate relative to crankpin 96, separating surfaces 102, 122. The separation of these surfaces would result in their subsequently slamming together as the rotating crankshaft catches up to the cam assembly, causing undue stresses on the components and undesirable noise. Further, the slamming together of surfaces 102, 122 may possibly occur more than once per revolution.

Components for latching cam assembly 104 into its full stroke, first angular position about cam shaft 40 are shown in FIG. 5, and include latch pin 150, cap 152 and compression spring 154. Latch pin 150 may be 4140 steel, or the equivalent, which has been quenched, tempered and nitrided, having a hardness of 28 to 32 HRC. As shown in FIG. 5, latch pin 150 is disposed in crossbore 156, which extends along axis 158. Axis 158 is perpendicular to central axis 95 of eccentric crankpin 96.

Figure 6:
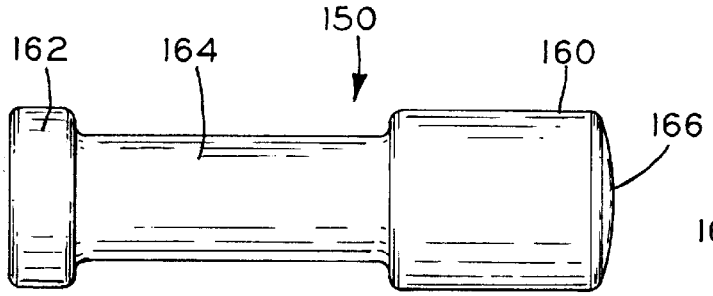
FIG. 6 is a side view of a latch pin according to the present invention.

Referring now to FIG. 6, latch pin 150 comprises cylindrical head 160, cylindrical foot 162 and cylindrical shank 164 extending between head 160 and foot 162. Head 160 and foot 162 are diametrically sized to slide within crossbore 156 with little clearance. The diameter of shank 164 is smaller than the head/foot diameter, allowing fluid to easily flow thereabout, as discussed further below. The terminal end of head 160 is provided with domed surface 166 having a spherical radius which is generally equivalent to that of the cylindrical wall of crankpin 96.

Figure 7:
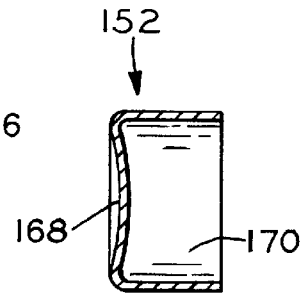
FIG. 7 is a sectional side view of a cap according to the present invention.

Referring now to FIG. 7, one end of cylindrical cap 152 is provided with concave recess 168 which is formed to generally match the domed shape of surface 166. Cap 152 is provided with inner cavity 170 in which one end of compression spring 154 is disposed. The opposite end of compression spring 154 abuts the conical, terminal end of radial bore 172 provided in base portion 108. In both the first and second cam assembly angular positions about crankpin 96, bore 172 is centered about axis 158. Radial bore 172 and crossbore 156 are of substantially same diametrical size. Bore 172 is of appropriate length such that spring 154, in its uncompressed state, and cap 152 arc entirely contained within; no portion of the cap extends above inner cylindrical surface 174 (FIG. 8B) of cam assembly 104.

Figure 8A:
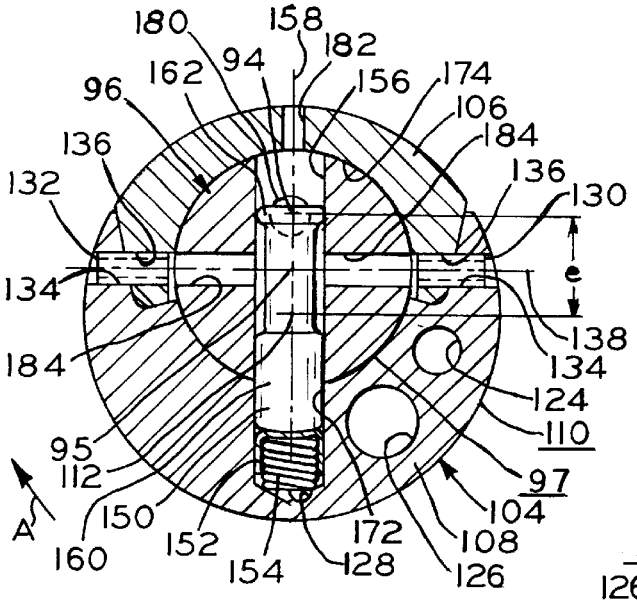
FIG. 8A is a sectional end view of the crankshaft and cam assembly of FIG. 4 along the line 8A—8A thereof, showing the cam assembly in a first angular position.

With reference now to FIG. 8A, when crankshaft 40 is rotated in the direction of arrow A, i.e., the forward direction, surfaces 102 of flange 98 and surface 122 of cam assembly driven portion 118 are brought into abutting engagement and bores 156 and 172 into axial alignment. Pin 150, under the influence of centrifugal force, is forced radially outward from crossbore 156 such that its head 160 extends across the interface of cylindrical crankpin surface 97 and cylindrical inner cam assembly surface 174. Spring 154 compresses under the load domed pin head surface 166 exerts on concave surface 168 of cap 152, allowing pin 150 to extend into bore 172, latching cam assembly 104 to crankpin 96 such that they may not rotate relative to one another.

Figure 8B:
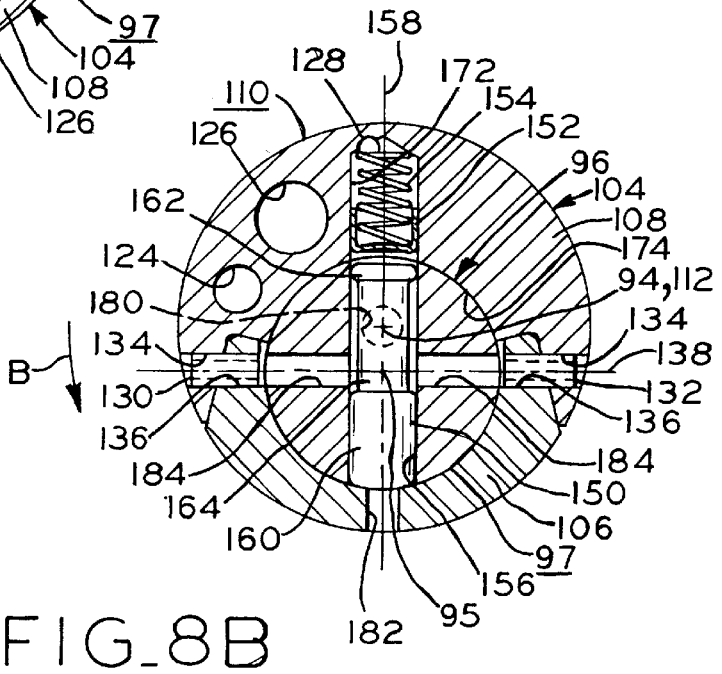
FIG. 8B is a sectional end view of the crankshaft and cam assembly of FIG. 8A, showing the cam assembly in a second angular position.

When crankshaft rotation ceases, spring 154 acts through cap 152 to force pin 150 back into crankpin crossbore 156. No part of cap 154 extends into crankpin crossbore 156, and no part of pin head 160 extends into radial cam assembly bore 172. Referring to FIG. 8B, as crankshaft 40 is rotated in the direction of arrow B, i.e., the reverse direction, such that surfaces 100 of flange 98 and 120 of cam assembly driven portion 118 are brought into abutting contact, cam assembly 104 rotates 180° about crankpin axis 95 such that axes 94 and 112 are colinear, and bores 156 and 172 are again both aligned along axis 158. In this position, with axes 94 and 112 superimposed, piston 56 in lowermost cylinder 74 is not stroked; cam assembly 104 merely rotates within rod strap 62 of connecting rod 52, which remains idle and imparts no reciprocating motion to piston 56. As mentioned above, the eccentricity of cam assembly outer surface 110 about crankshaft axis of rotation 94 need not be fully eliminated during reverse crankshaft rotation. The eccentricity may alternatively be reduced to a fraction of its value during forward rotation.

As shown in FIG. 1, portion 65 of crankshaft 40, which is supported in outboard bearing 64, extends below the surface level of the oil in sump 70. Extending axially through crankshaft 40 is oil lubrication passage 180, one end of which opens into submerged crankshaft end 67 (FIG. 5). Oil lubrication passage 180 generally extends along crankshaft axis of rotation 94 and communicates with latch pin crossbore 156. As shown in FIG. 8A, with latch pin 150 in its latched position, its head 160 extending into radial cam assembly bore 172, the axial length of pin foot 162 is centered across passageway 180 such that oil may flow therefrom to either axial side of foot 162. The portion of oil which flows to the terminal end side of foot 162 will flow along crossbore 156 to radial vent passage 182 provided in cam assembly yoke portion 106. Vent passage 182 is generally centered about axis 158 in the first and second cam assembly angular positions about crankpin 96, and oil passing therethrough lubricates the slidable interface between cam assembly outer cylindrical surface 110 and the inner cylindrical rod strap surface of connecting rod 52. The portion of oil which flows to the opposite side of pin foot 162, around shank 164, flows to second crossbore 184 in eccentric crankpin 96. With cam assembly 104 in either of its first or second angular positions about crankpin 96, crossbore 184 is aligned with bores 134, 136 and hollow spring pins 130, 132 therein. Oil received in crossbore 184 flows through spring pins 130, 132 to lubricate the interface of outer cam assembly surface 110 and the surrounding interior cylindrical rod strap surface of connecting rod 52.

Referring now to FIG. 8B, in which cam assembly 104 is shown in its second angular position, with pin 150 entirely disposed within crossbore 156, oil will flow from axial passageway 180 into crossbore 156 between pin head 160 and pin foot 162, flowing about and along shank 164 to second crossbore 184 and again through spring pins 130, 132 to lubricate the interface of outer cam assembly surface 110 and the surrounding interior cylindrical rod strap surface of connecting rod 52. In either of the cam assembly first and second angular positions, any oil which may accumulate in bore 156 or bore 172 may be evacuated near the terminal ends of the bores through radial vent passageway 182 provided in yoke portion 106 or through axial hole 128, which is in fluid communication with the terminal end of bore 172. Thus the movement of pin 150 along axis 158 will not be impeded by excessive oil pressure acting thereon directly or through cap 152.

Referring now to FIGS. 9A–9D, there is shown an alternative embodiment of a cam assembly according to the present invention. Cam assembly 104' is identical to cam assembly 104 in its outer shape. Yoke portion 106' and base portion 108', however, are interfitted axially rather than radially, with base portion 108' comprising circumferentially extending legs 204, 206 each having, at the end thereof, axially extending lip 200 which is received in mating groove 202 provided in yoke portion 106'. Yoke portion 106' is similarly provided with circumferentially extending legs 208 and 210 which lie axially adjacent base portion legs 204 and 206, respectively. The interfacing axial surfaces of legs 204, 208 and 206, 210, 208 are provided with interfitting convolutions 212, 214 which aid in seating the base and yoke portions together.

Figure 9A:
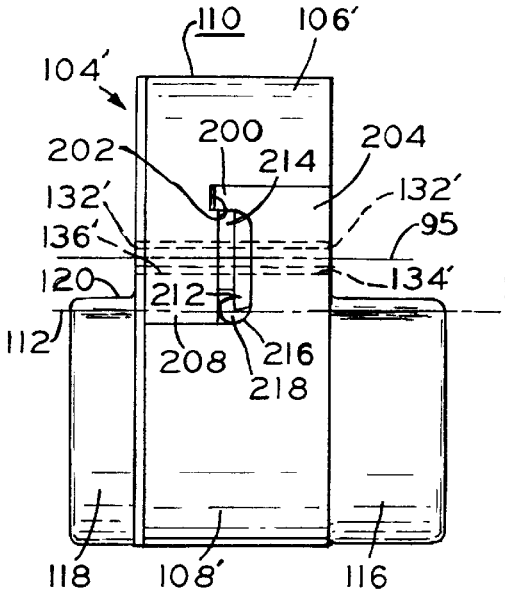
FIG. 9A is a first side view of a second embodiment of a cam assembly according to the present invention.
Figure 9B:
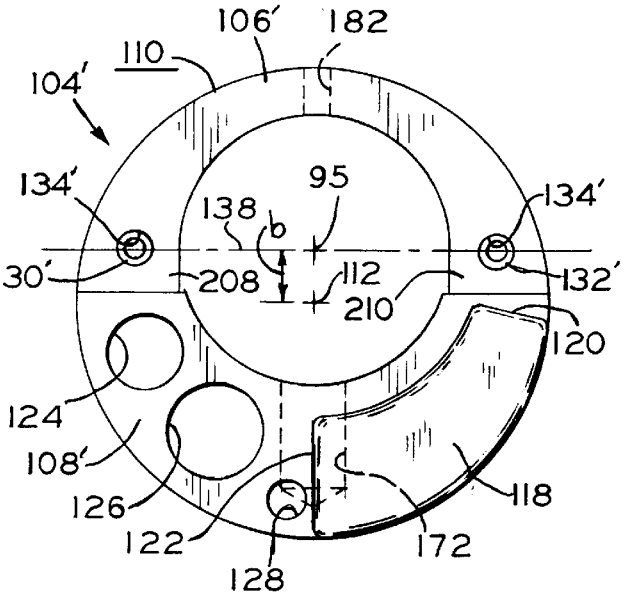
FIG. 9B is an end view of the cam assembly of FIG. 9A.
Figure 9C:
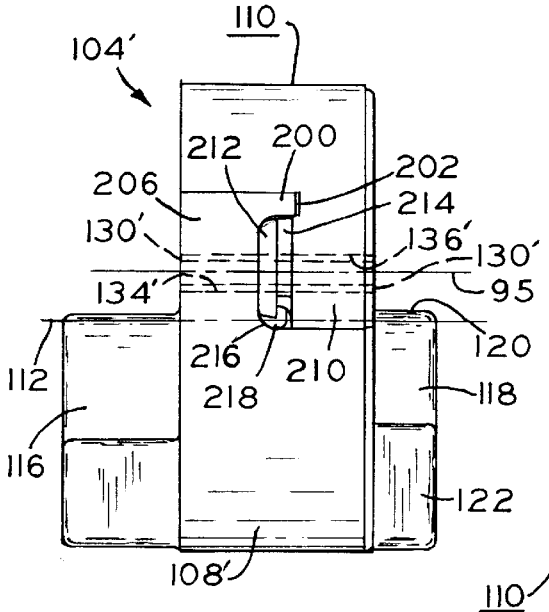
FIG. 9C is a second side view of the cam assembly of FIG. 9A.
Figure 9D:
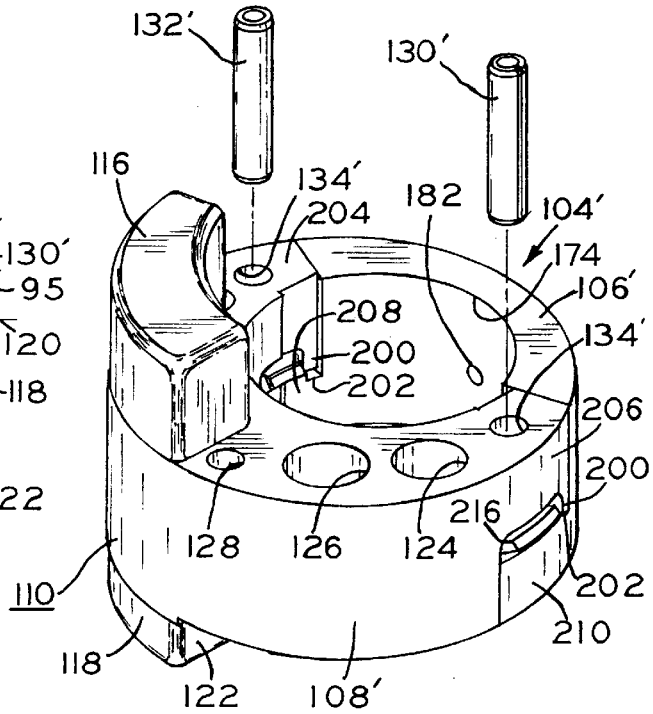
FIG. 9D is a partially exploded, perspective view of the cam assembly of FIGS. 9A–9C.

Base portion legs 204, 206 are provided with axial bores 134' which, when base portion 108' and yoke portion 106' are assembled, are aligned with bores 136' provided in yoke portion legs 208, 210. Extending through bores 136' and 134' are hollow spring pins 130' and 132' which hold base portion 108' and yoke portion 106' together. As seen in FIGS. 9A, 9C, base portion 108' is provided with radiused corners 216 where its legs 204, 206 are attached to its main body, adjacent the end of convolution 212. Convolutions 214 on yoke portion legs 208 and 210 terminate near the legs' free ends. The space defined by corners 216, the adjacent axial surface of yoke portion legs 208, 210, and the adjacent ends of convolutions 212, 214 provides radial aperture 218 in cam assembly 104' through which oil may flow from second crankpin crossbore 184 to lubricate the interface of surface 110 and the surrounding inner cylindrical rod strap surface of connecting rod 52. Cam assembly components 106' and 108', like their counterpart components 106 and 108, may be made of sintered powder metal.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reciprocating piston compressor comprising:

at least one cylinder;

a reciprocable piston disposed in said cylinder;

a crankshaft rotatable in both a forward and a reverse direction, said crankshaft having a cylindrical eccentric portion; and a cam disposed about said eccentric portion, said piston operatively connected to said cam, said cam rotatable about said eccentric portion between a first position corresponding to a first piston stroke length during forward rotation of said crankshaft, and a second position corresponding to a second piston stroke length during reverse rotation of said crankshaft;

wherein, in one of said first and second positions, said cam is rotatably locked to said eccentric portion.

2. The compressor of claim 1, wherein said cam is rotatably locked to said eccentric portion by means of a pin.

3. The compressor of claim 2, wherein said pin is slidably disposed in a recess provided in said eccentric, said pin extended radially from said eccentric under the influence of centrifugal force into engagement with said cam.

4. The compressor of claim 3, wherein said cam is provided with a recess into which said radially extended pin is received.

5. The compressor of claim 4, wherein said cam recess is provided with a spring, said spring biasing said pin into said eccentric recess and out of said cam recess.

6. The compressor of claim 1, wherein said cam comprises at least one counterweight portion.

7. The compressor of claim 6, wherein said counterweight portion comprises having first and second driven faces, and said crankshaft comprises a flange having first and second driving faces, said first driven face and said first driving face abutting in said first position, said second driven face and said second driving face abutting in said second position.

8. The compressor of claim 7, wherein said cam counterweight portion extends generally axially from said cam, said first driven face generally lying in a first plane, said second driven face generally lying in a second plane, said first and second planes intersecting along the axis of rotation of said cam, said crankshaft flange extending generally radially from said crankshaft, said first driving face generally lying in a third plane, said second driving face generally lying in a fourth plane, said third and fourth planes intersecting along the central axis of said eccentric portion, said first and third planes coextending in said first position, said second and fourth planes coextending in said second position.

9. The compressor of claim 1, wherein said cam is unitary, said crankshaft comprising a plurality of interconnected crankshaft pieces.

10. The compressor of claim 1, wherein said cam comprises a plurality of pieces, said cam pieces interfitted about said eccentric portion.

11. The compressor of claim 1, wherein said first and second piston stroke lengths are different.

12. The compressor of claim 11, wherein one of said first and second piston stroke lengths is zero.

13. A reciprocating piston compressor comprising:

at least one cylinder;

a reciprocable piston disposed in said cylinder;

a crankshaft rotatable in a forward and a reverse direction, said crankshaft having a cylindrical eccentric portion;

a cam disposed about said eccentric portion, said piston operatively connected to said cam, said cam rotatable about said eccentric portion between a first position corresponding to a first piston stroke length during forward rotation of said crankshaft, and a second position corresponding to a second piston stroke length during reverse rotation of said crankshaft; and means for locking said cam with said eccentric portion in one of said first and second positions.

* * * * *

Adverse Decision In Interference

Patent No. 5,951,261, Andrew Paczuski, REVERSIBLE DRIVE COMPRESSOR, Interference No. 105,119, final judgment adverse to the patentee rendered November 13, 2003, as to claims 1, 2, 6, 7, and 9-12.

*(Official Gazette April 20, 2004)*